US011533996B2

(12) United States Patent
Stone

(10) Patent No.: US 11,533,996 B2
(45) Date of Patent: Dec. 27, 2022

(54) APPARATUS FOR SECURING ACCESSORIES AND LEVELING OBJECTS TO WIRE SHELVING

(71) Applicant: Kid Genius, LLC, Ridgefield, CT (US)

(72) Inventor: George Colvin Stone, Ridgefield, CT (US)

(73) Assignee: Kid Genius, LLC, Ridgefield, CT (US)

( * ) Notice: Subject to any disclaimer, the term of this patent is extended or adjusted under 35 U.S.C. 154(b) by 0 days.

(21) Appl. No.: 17/133,435

(22) Filed: Dec. 23, 2020

(65) Prior Publication Data

US 2022/0192379 A1 Jun. 23, 2022

(51) Int. Cl.
*A47B 96/06* (2006.01)

(52) U.S. Cl.
CPC .... *A47B 96/068* (2013.01); *A47B 2220/0041* (2013.01)

(58) Field of Classification Search
None
See application file for complete search history.

(56) References Cited

U.S. PATENT DOCUMENTS 3,765,534 A 10/1973 Stempel
3,765,634 A * 10/1973 Stempel ..... F16B 7/0433 403/384
4,316,593 A 2/1982 Miner et al.
4,573,654 A 3/1986 Nottingham
4,697,712 A 10/1987 Valiulis
4,893,772 A 11/1990 Remmers
5,597,077 A * 1/1997 Hartmann ..... A47F 5/0056 211/183
5,758,851 A 6/1998 Remmers
5,794,953 A 8/1998 Duchene et al.
5,934,639 A 8/1999 Chiang et al.
6,189,847 B1 * 2/2001 Hart ..... B25H 3/04 248/220.31
6,454,487 B1 9/2002 Buenning et al.
6,669,036 B1 12/2003 Yang et al.
7,523,899 B2 4/2009 Cormier
8,523,127 B1 9/2013 Bennett
8,871,324 B2 10/2014 Hansel et al.
9,788,667 B2 10/2017 Williams et al.
10,736,441 B1 * 8/2020 Phy ..... A47B 57/581
(Continued)

FOREIGN PATENT DOCUMENTS

AT 221627 8/2002
DE 19813568 12/1999
(Continued)

*Primary Examiner* — Steven M Marsh
(74) *Attorney, Agent, or Firm* — Lance C. Venable; Law Office of Lance C. Venable, PLLC

(57) ABSTRACT

In various representative aspects, an apparatus for securing accessories to a steel-wired shelf. More specifically, the apparatus is an interface that conforms to the shapes of openings in the side panels on the shelf units and provides an interference fit. A variety of accessories can be secured to the interfaces by using a standard nut and bolt connection means. A second embodiment pertains to an interface that is secured to the evenly spaced horizontal wire arrays on the shelves that can level objects that are placed on top of the wire array. Various embodiments of the apparatuses are also provided.

14 Claims, 12 Drawing Sheets

(56) References Cited

U.S. PATENT DOCUMENTS

| | | | | |
|---|---|---|---|---|
| 2006/0054063 | A1 | 3/2006 | Ryan, Jr. | |
| 2012/0068032 | A1 | 3/2012 | Stockman | |
| 2013/0082155 | A1 | 4/2013 | McCromack | |
| 2018/0064264 | A1* | 3/2018 | Williams | A47F 5/0031 |
| 2020/0320904 | A1* | 10/2020 | Phy | A47B 57/581 |

FOREIGN PATENT DOCUMENTS

| | | |
|---|---|---|
| DE | 59902186 | 9/2002 |
| EP | 1064465 | 1/2001 |
| JP | 2002510024 | 4/2002 |
| WO | 9950564 | 10/1999 |

* cited by examiner

APPARATUS FOR SECURING ACCESSORIES AND LEVELING OBJECTS TO WIRE SHELVING

BACKGROUND OF INVENTION

Field of the Invention

The present invention relates generally to steel-wired shelf units that come in a variety of sizes shelf levels. More specifically, the present invention relates to apparatuses that enable certain accessories to be secured to the shelf units to increase their function, utility and provide for greater efficiency and added space to store accessories inside a home, office, or workspace.

The exemplary embodiments shown herein offer a system and apparatus that is designed to secure items to the steel-wired shelf units that would otherwise normally be attached to a wall. Specifically, two exemplary embodiments pertain to interfaces that conform to the triangular-shaped openings in the side panels on the shelf units and provide an interference fit. A variety of accessories can be secured to the interfaces by using a standard nut and bolt connection means. A second embodiment pertains to an interface that is secured to the evenly spaced horizontal wire arrays on the shelf units that can level objects that are placed on top of the wire array.

Description Of the Related Art

Any discussion of the prior art in the specification should in no way be considered as an admission that the prior art is widely known or forms part of common general knowledge in the field.

Steel wire shelf unit like those shown in FIG. 21 are very commonly used in kitchen pantries, offices, and garages or storage units. These units come in a variety of sizes, with the most popular being between 36 to 48 inches wide, by 14 or 18 inches deep and 54 to 72 inches tall. The shelf units typically come in a chrome, painted or vinyl surface finish. While these shelves are strong, easy to assemble, and fairly inexpensive, they are not easily modified. It is desirable to secure various accessories to the shelves in simple and easily installable manner that increases the shelves' function and utility depending on their location. For example, a painted shelf unit in the garage might have a more "do it yourself" feel as opposed to a chrome unit in the kitchen, where any modifications need to have a more finished look. It is also desirable to provide an apparatus that will enable the accessories to be secured to the most common steel wire shelves on several locations on the shelves.

Other devices that are secured to steel wire shelves are known. For example, in U.S. Pat. No. 3,765,634 issued to Stempel, a joiner support for joining two open shelves on their respective facades is known. But this device does not disclose a device capable of securing accessories to the shelves.

U.S. Pat. No. 4,316,593 issued to Miner et al discloses a connecting plate for joining wall-mounted self-support brackets together along the façade of the wire shelf. But it does not disclose a device capable of securing accessories to the shelves.

U.S. Pat. No. 4,573,654 issued to Nottingham discloses a mounting structure for a crib toy. This device does not provide any means to secure accessories to wire shelves.

U.S. Pat. No. 4,697,712 issued to Valiulis discloses a bracket for a grid-type rack. But the bracket does not disclose any means to secure accessories to wire shelves.

U.S. Pat. No. 5,758,851 issued to Remmers discloses a bracket assembly that is attached to the façade of a wire frame shelf that is used to receive a rod that can be used to hang clothes from. Although this device does provide a means to add accessories to the shelf, the bracket requires external hardware and occupies space beyond the bracket itself—both of which are undesirable.

U.S. Pat. No. 6,454,487 issued to Buenning discloses a device for securing elements to a wire grid. Although this device provides a similar structural form, the device does not offer a fastening means that the present invention provides.

US Patent Pub. 2012/0068032 issued to Stockman discloses metal hooked utility bracket assembly that includes a plurality of hooks for mounting the bracket assembly on the façade of a wire frame shelf that allows an accessory, such as a basket, to be attached to the bracket assembly. Although the bracket does enable a person to secure accessories to the bracket, the means for securing the bracket to the wire frame shelf is inventively distinct from the present invention.

U.S. Pat. No. 8,523,127 issued to Bennett discloses an attachment device to chain link fences for holding apparatuses. This device does provide a base portion that includes an interference fit within the contours of the fence and provides a receiver portion that extends outward from the base portion for holding apparatuses. But this device does not provide the same interference fit means that the present invention provides. Moreover, the present invention does not require a receiver portion that extends from the device for holding external accessories.

U.S. Pat. No. 9,788,667 issued to Williams et al discloses a fastener for securing a rail to a wire shelf. Although this device has a securing means to a wire shelf and can provide a means for securing accessories to the fasteners, the present invention accomplishes this in a distinct and more efficient way.

An apparatus that provides a simple, efficient, and inexpensive means to attach accessories to multi-layer wire shelves with various geometrically shaped facades and wire array shelves is desired that overcomes the limitations of the prior art. The present invention overcomes these limitations and offers a solution that enables a person to secure almost any item to the wire shelf that can be attached to a wall that is both easy to install and use.

SUMMARY OF THE INVENTION

The invention is summarized below only for purposes of introducing embodiments of the invention. The ultimate scope of the invention is to be limited only to the claims that follow the specification.

It is an object of this invention to provide an apparatus for securing an accessory to a wire shelf.

It is a further object of this invention that the apparatus comprises a rear face with a front and rear side.

It is a further object of this invention that the front face comprises an aperture that is configured to receive a fastener.

It is a further object of this invention that the perimeter of the front face is less than the perimeter of the rear face.

It is a further object of this invention that the front face is triangular.

It is a further object of this invention that the rear face includes a nut that is axially aligned with the aperture of the front face.

It is a further object of this invention that the front face comprises at least one nib.

It is a further object of the present invention that the rear face comprises a pair of lateral sections that extend outward from the front side of the rear face.

It is a further object of the present invention that the pair of lateral sections further comprise apertures that extend through the width of the lateral sections.

It is a further object of the present invention that the pair of lateral sections further comprise nuts that are axially aligned with the apertures in each of the lateral sections.

It is an object of an alternate embodiment of the present invention to provide an apparatus for leveling objects on a wire shelf.

It is a further object of the alternate embodiment of the present invention to provide a tray with a top surface that has a first pair of grooves along the length of opposite sides of the top surface and a nut holder that is configured to receive a nut.

It is a further object of the alternate embodiment of the present invention for the tray to further comprise a bottom surface, and an aperture that extends through the top and bottom surfaces that is axially aligned with the nut holder.

It is a further object of the alternate embodiment of the present invention to provide a spacer with an opening that is axially aligned with the aperture in the tray and is configured to receive a fastener.

It is a further object of the alternate embodiment of the present invention for the spacer to further comprise a pair of pegs that are aligned to be inserted into a pair of holes on the tray.

It is a further object of the alternate embodiment of the present invention for the tray to further comprise a second pair of grooves on the bottom surface of the tray such that the distance between the second pair of grooves is smaller than the distance between the first pair of grooves.

A person with ordinary skill in the relevant art would know that any shape or size of the elements described below may be adopted. Any combinations of suitable number, shape, and size of the elements described below may be used. Also, any materials suitable to achieve the object of the current invention may be chosen as well.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

DETAILED DESCRIPTION OF THE INVENTION

In the following description, and for the purposes of explanation, numerous specific details are provided to thoroughly understand the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed embodiments may be applied. The full scope of the invention is not limited to the example(s) that are described below.

Figure 1:
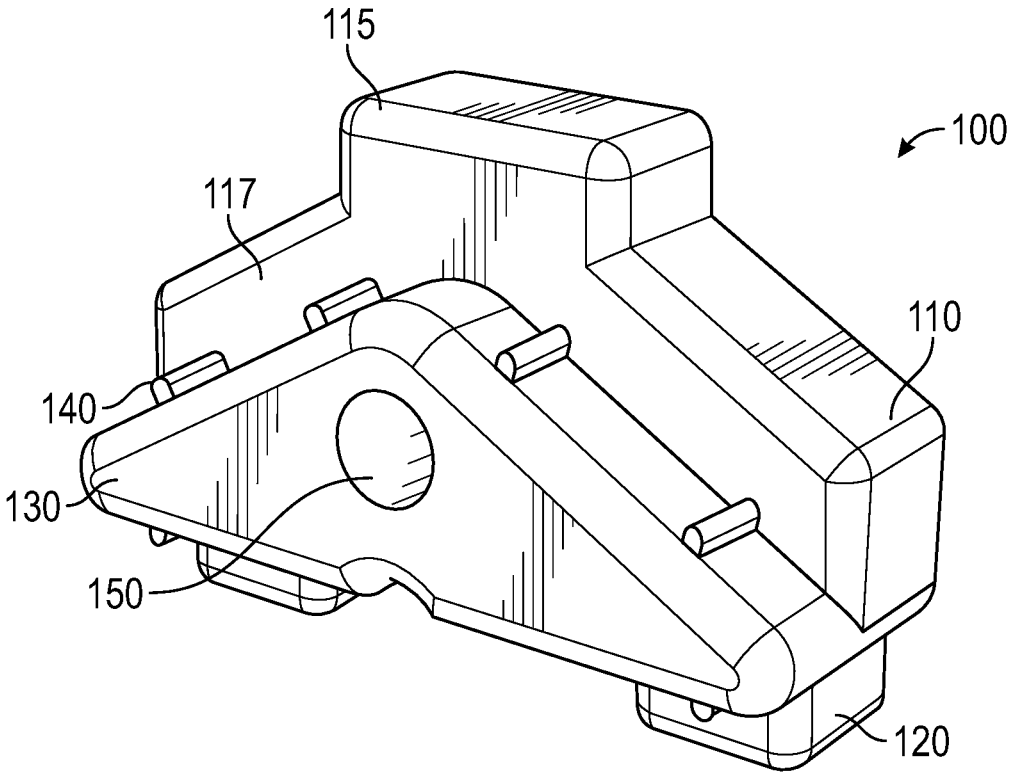
FIG. 1 illustrates a perspective view of an exemplary embodiment of the present invention with a single opening for receiving accessories for use with a triangular mesh façade of a wire shelf.
Figure 2:
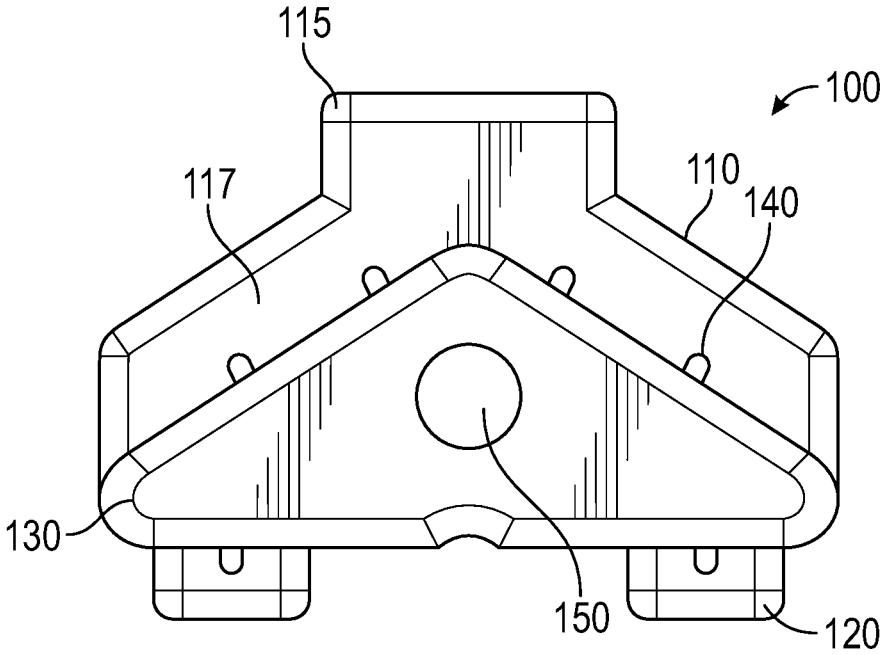
FIG. 2 illustrates a front view of the embodiment shown in FIG. 1.
Figure 7:
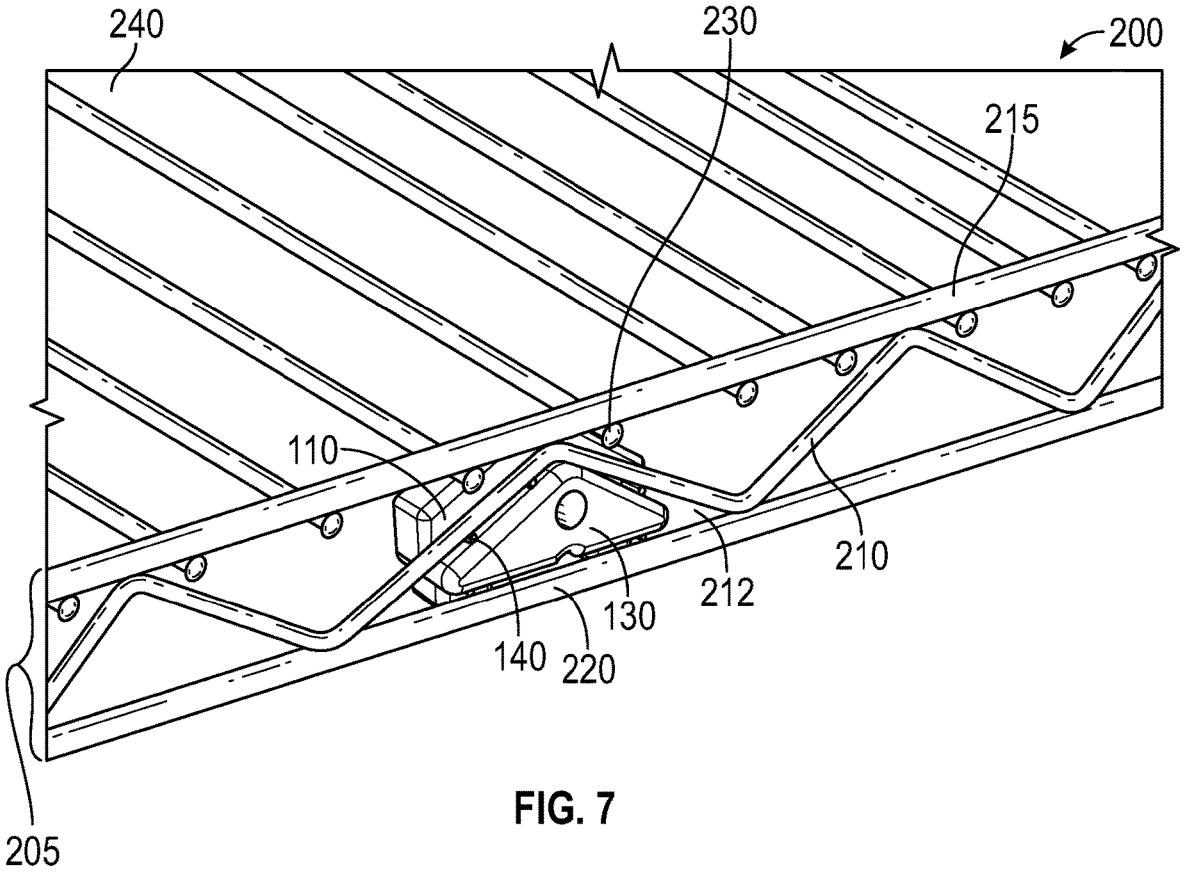
FIG. 7 illustrates a perspective view of the embodiment shown in FIG. 1 in use with a wire shelf with a triangular façade.

FIGS. 1 and 2 illustrate a perspective view and a front view of an exemplary embodiment of the present invention. A wire nut 100 is shown. The wire nut 100 is designed to fit in a first opening 212 of a side panel or façade 205 of a wire shelf 200 as shown in FIG. 7. The wire nut 100 comprises a front face 130 that, in this embodiment, is comprised of molded plastic or similarly rigid material with a thickness that is at least as great as the first opening 212. In the case when the first opening 212 is triangular, the front face 130 is also triangular. Each side of the outer surface of the perimeter of the front face 130, comprises at least one nib 140. The nibs 140 are of sufficient quantity to provide both an interference fit, and the ability to maintain the front face 130 centered within the first opening 212 when the front face 130 is inserted into the first opening 212. The nibs 140 can be removed or reduced so the front face 130 will fit a slightly different size first opening 212 in different shelves from different manufactures. It is understood by one of ordinary skill in the art that the front race 130 could be fit within the first opening 212, regardless of the first opening's 212 orientation, as long as the front face 130 can conform to the first opening 212 to create a sufficiently rigid interference fit.

Figure 21:
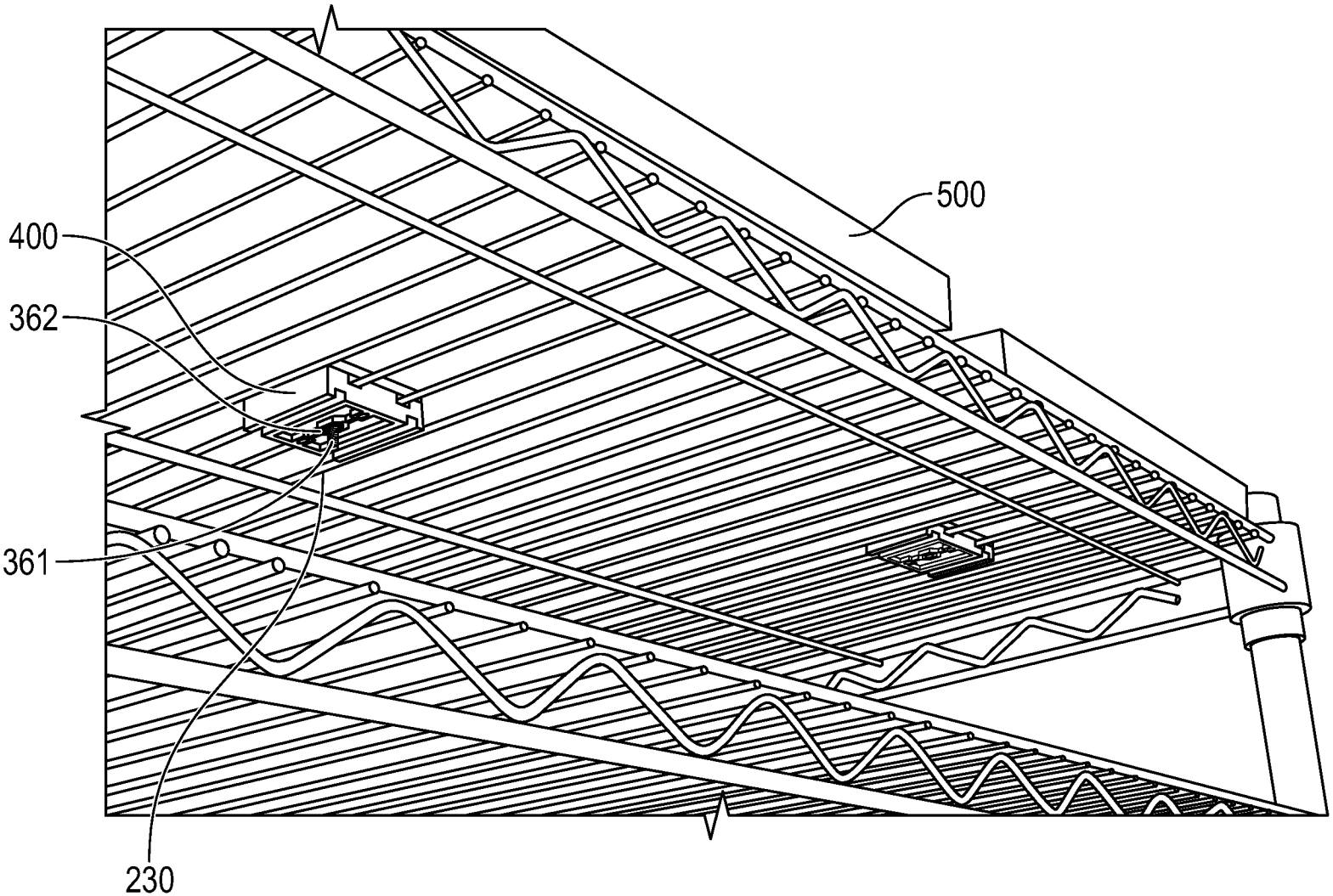
FIG. 21 illustrates a perspective view of the mount shown in FIG. 15 in use on the surface of a wire shelf.

A rear face 110 is coupled to the back side of the front face 130. It is understood by one of ordinary skill in the art that the rear face 110 and the front face 130 could comprise a unitary element. The rear face 110 comprises a front surface area 117 that is larger than the front face 130. The rear face 110 as shown comprises a top portion 115 and a bottom portion 120, which in this embodiment is a pair of legs extending downward. The front face 130 further includes an aperture 150 for receiving a fastener such as a screw or bolt 361 as shown in FIG. 21. By the rear face 110 having a larger front surface area than the front face 130, the front face 130 can be inserted into the first opening 212 using the rear face 110 so that the rear face 110 can act as a backstop and maintain the front face 130 within the contour of the first opening 212.

Figure 3:
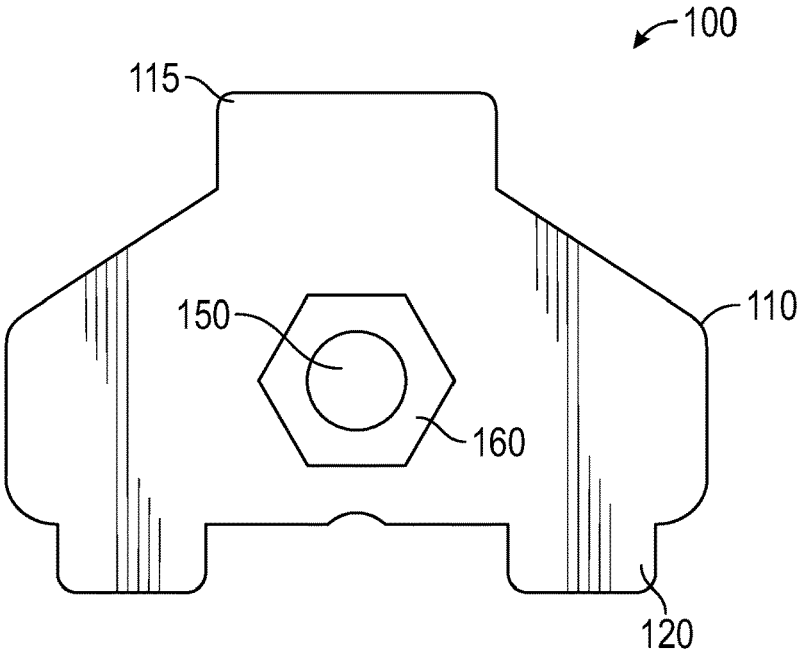
FIG. 3 illustrates a rear view of the embodiment shown in FIG. 1.
Figure 4:
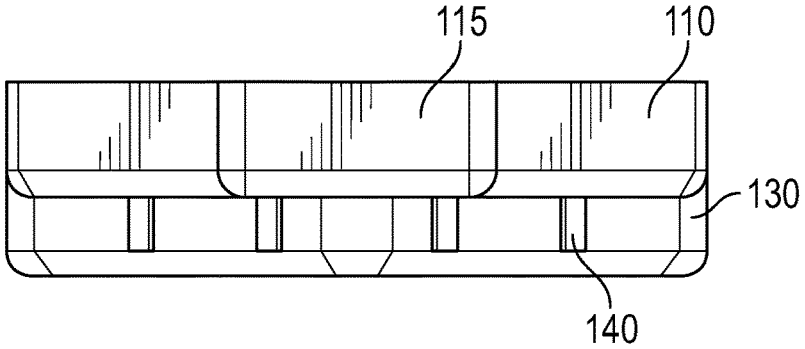
FIG. 4 illustrates a top view of the embodiment shown in FIG. 1.
Figure 5:
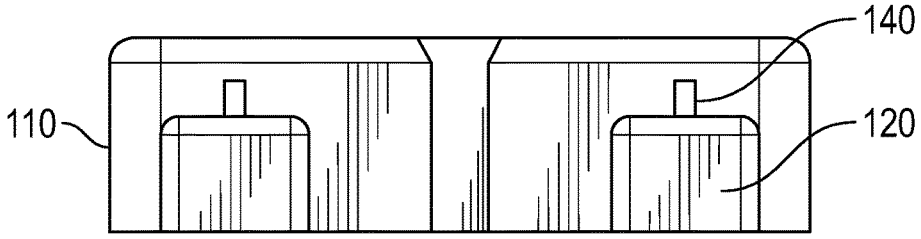
FIG. 5 illustrates a bottom view of the embodiment shown in FIG. 1.
Figure 6:
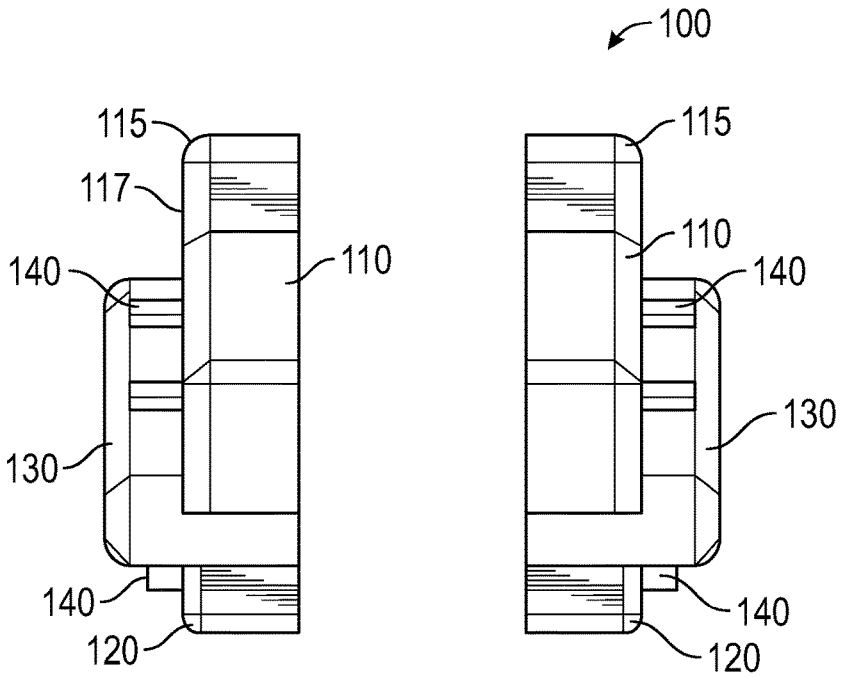
FIG. 6 illustrates a pair of side views of the embodiment shown in FIG. 1.

FIG. 3 illustrates a rear view of the apparatus showing the back surface of the rear face 110. A hexagonal nut 160 is embedded in the rear face 110 as shown. The nut 160 is threaded and is axially aligned with the aperture 150 and is compatible with the bolt 361 so that an external accessory can be secured to the wire nut 100 when the bolt 361 is inserted through the aperture 150. FIGS. 4-6 show various views of the wire nut 100 as shown in FIGS. 1-3.

FIG. 7 illustrates a perspective view of an assembled wire nut 100 in the façade 205 of the wire shelf 200. The wire shelf 200 includes the planar mesh 240 of wires 230 that are perpendicular to the façade 205. The façade 205 includes a continuous triangular wire 210 positioned between an upper bar 215 and a lower bar 220. As can be seen, the wire nut 100 is inserted through the first opening 212 of the façade 205 and the nibs 140 that are positioned on the outer surface of the perimeter of the front face 130 create an interference fit within the triangular wire 210.

Figure 13:
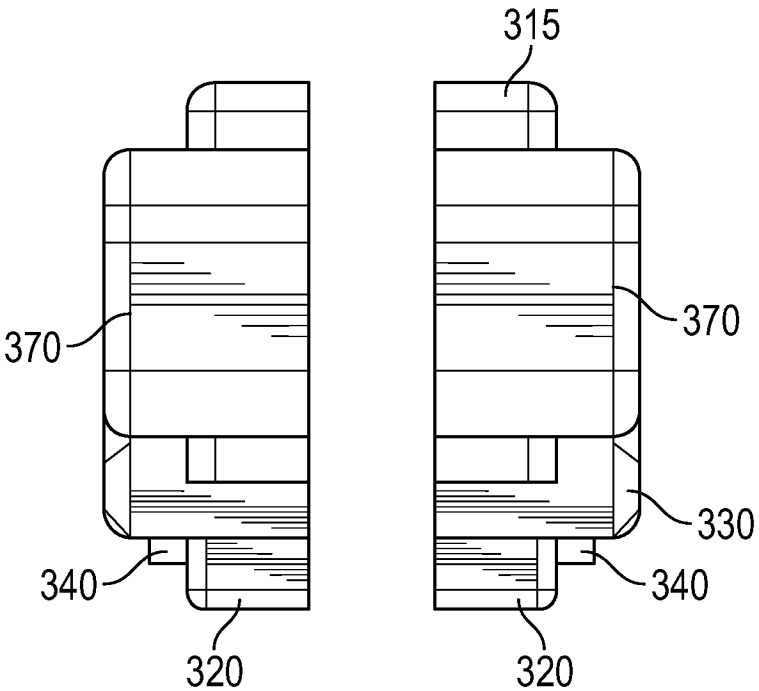
FIG. 13 illustrates a pair of side views of the embodiment shown in FIG. 8.
Figure 13A:
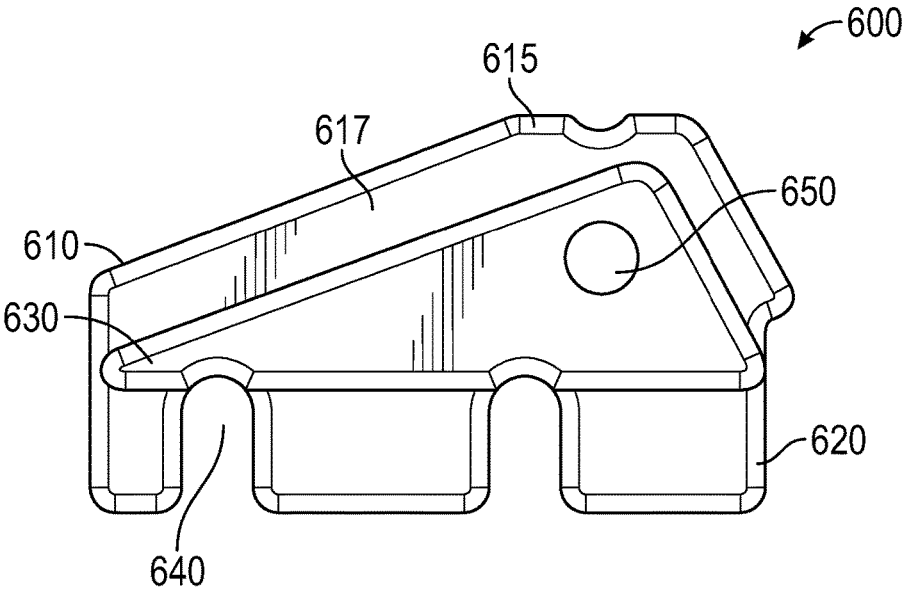
FIG. 13A illustrates a front view of an alternate exemplary embodiment of the embodiment shown in FIGS. 1-6.
Figure 14:
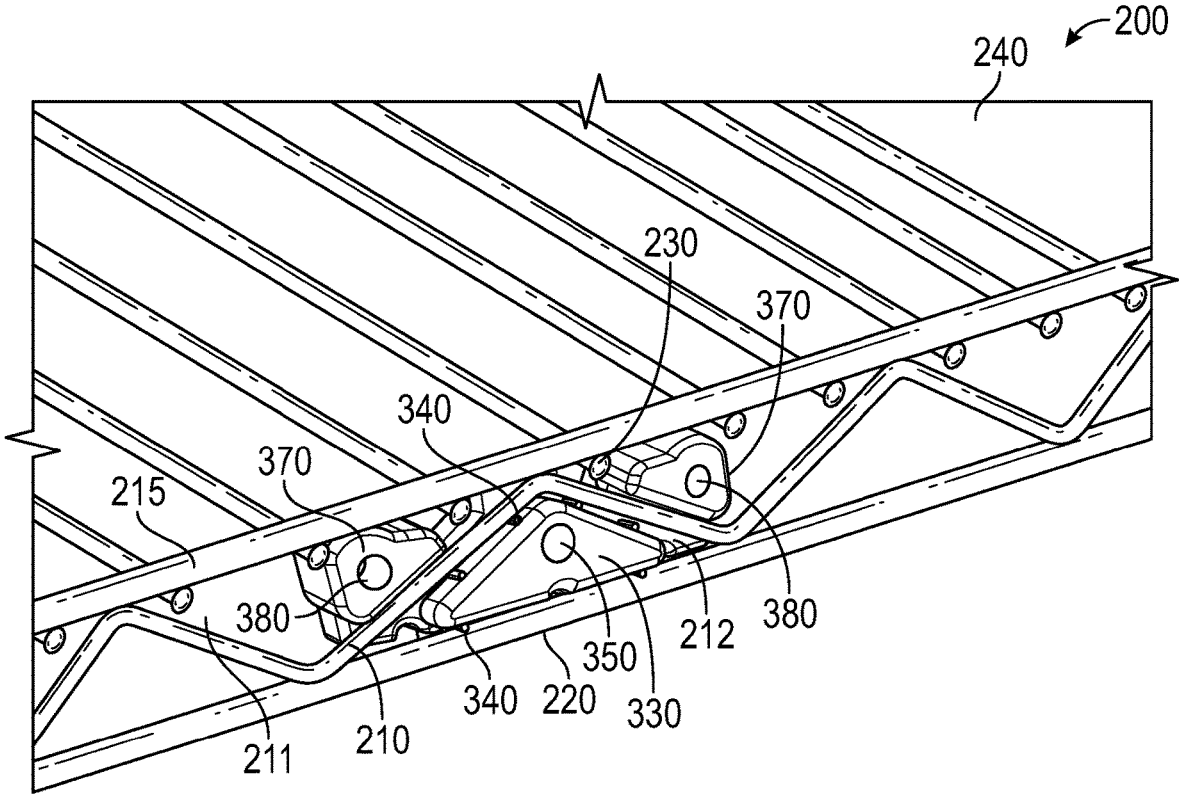
FIG. 14 illustrates a perspective view of the embodiment shown in FIG. 8 in use with a wire shelf with a triangular façade.
Figure 14A:
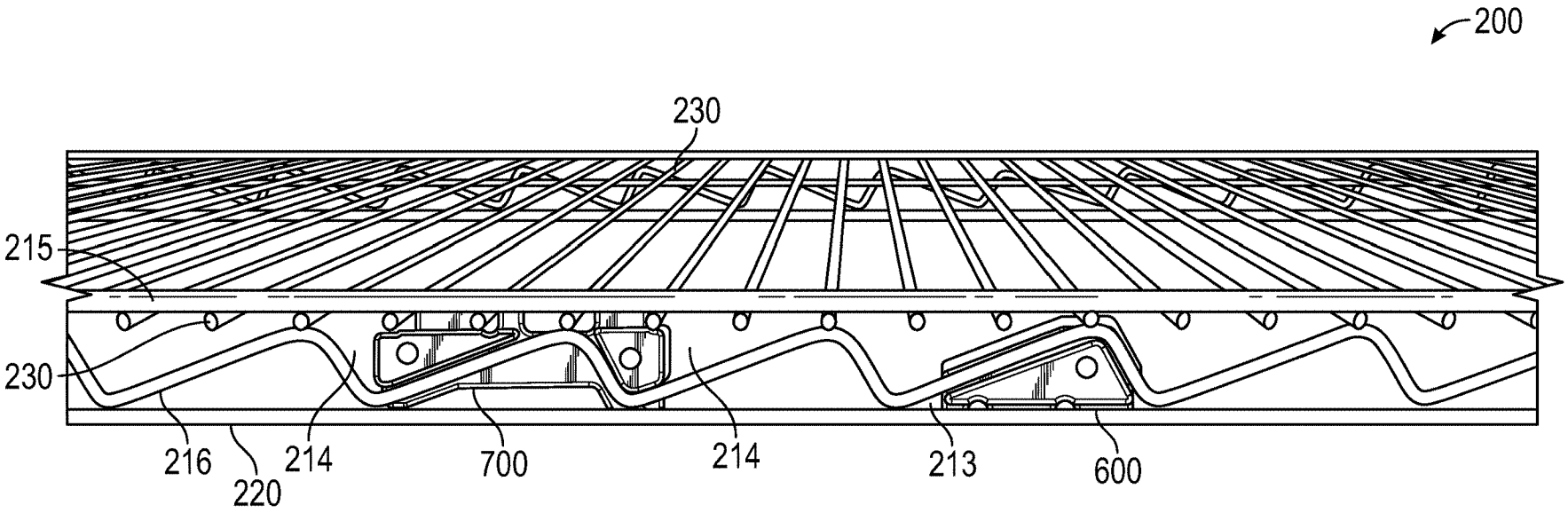
FIG. 14A illustrates a perspective view of an alternate exemplary wire shelf with a variation of the façade of the shelf in FIG. 14 that includes the embodiments shown in FIGS. 13A and 13B.

FIG. 13A illustrates a front view of an alternate exemplary embodiment of the embodiment shown in FIGS. 1-6. A wire nut 600 is shown that is designed to fit in a first opening 213 of a side panel or façade 205 of a wire shelf 200 as shown in FIG. 14A. The first opening 213 in this embodiment of the wire shelf 200 is an elongated triangle formed by the elongated wire 216, which is a variation of the shape of wire 210. The wire nut 600 comprises a front face 630 that, in this embodiment, is comprised of molded plastic or similarly rigid material with a thickness that is at least as great as the first opening 213. In this embodiment, no nibs 140 are attached to the outer surface of the front face 630, although it is understood that nibs 140 could be present.

A rear face 610 is coupled to the back side of the front face 630. It is understood by one of ordinary skill in the art that the rear face 610 and the front face 630 could comprise a unitary element. The rear face 610 comprises a front surface area 617 that is larger than the front face 630. The rear face 610 as shown comprises a top portion 615 and a bottom portion 620, which in this embodiment is a plurality of legs extending downward that also form recessed portions 640. The recessed portions can fit over wires 230 if necessary. The front face 630 further includes an aperture 650 for receiving a fastener such as a screw or bolt 361 as shown in FIG. 21. By the rear face 610 having a larger front surface area 617 than the front face 630, the front face 630 can be inserted into the first opening 213 using the rear face 610 as a backstop to maintain the front face 630 within the contour of the first opening 213.

As with the wire nut 100, a hexagonal nut 160 is embedded in the rear face 610 (not shown) that is threaded and is axially aligned with the aperture 650 and is compatible with the bolt 361 so that an external accessory can be secured to the wire nut 600 when the bolt 361 is inserted through the aperture 650.

Figure 8:
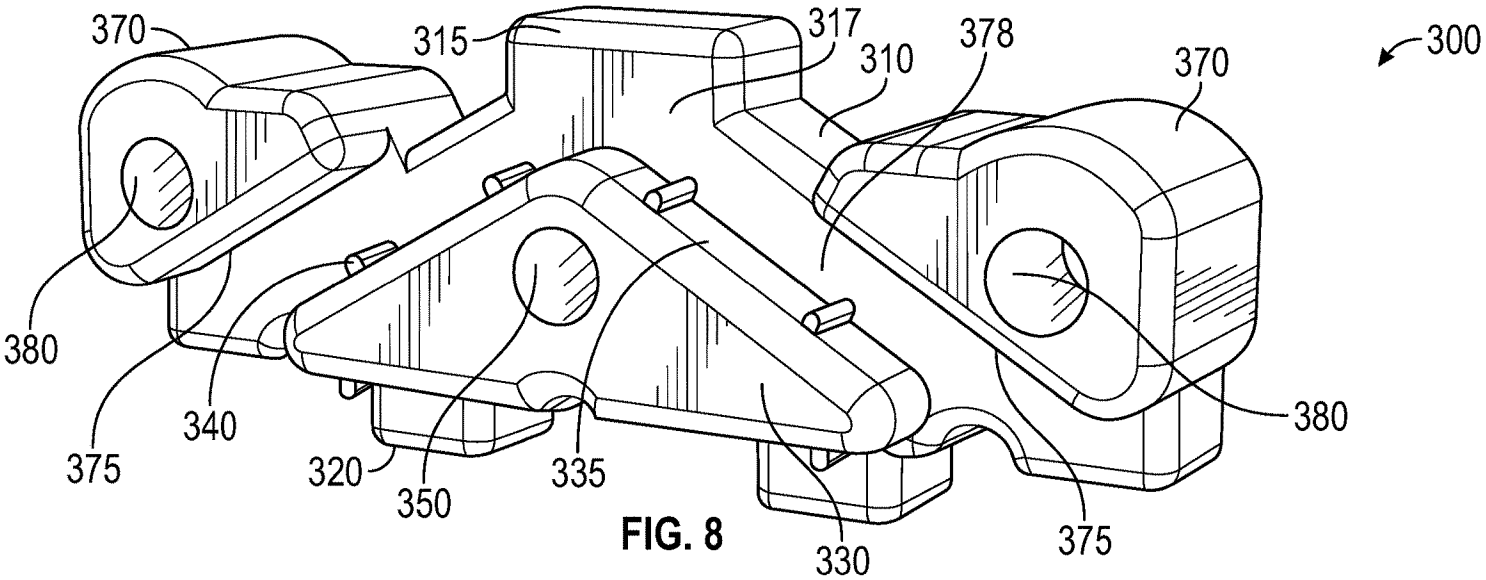
FIG. 8 illustrates a perspective view of an alternate exemplary embodiment of the invention that includes additional openings for receiving accessories that may require additional connection points.
Figure 9:
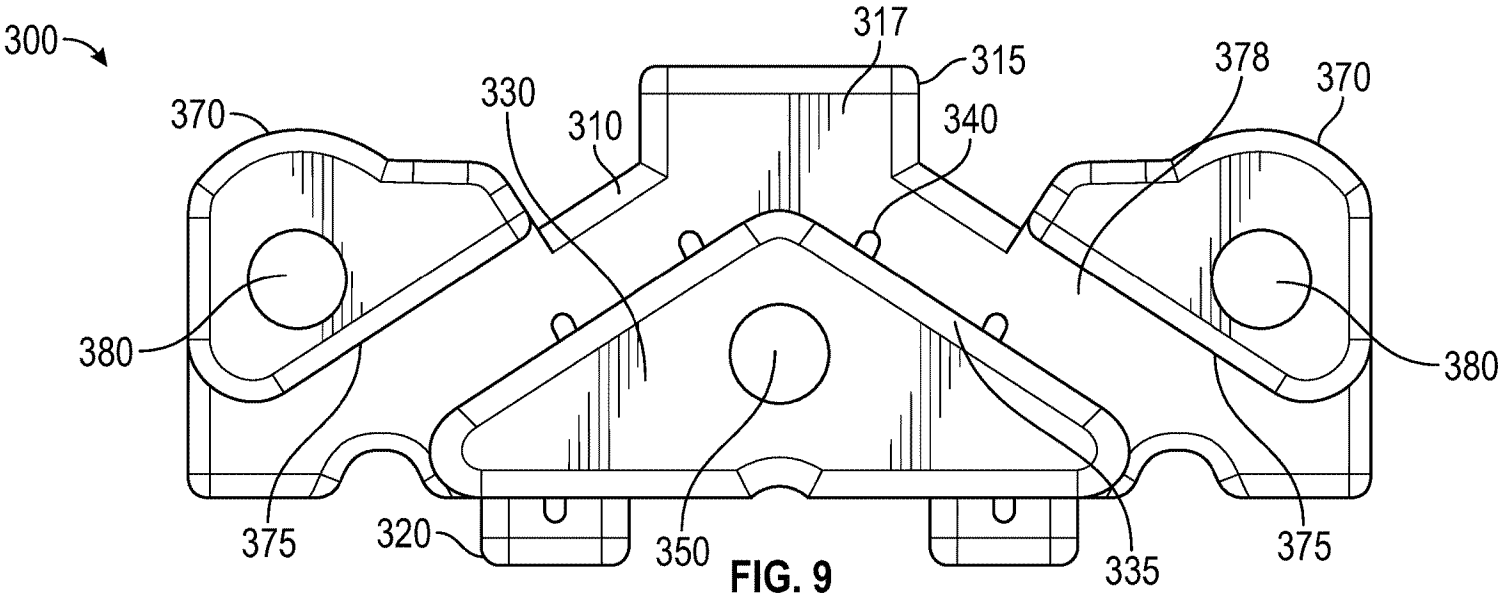
FIG. 9 illustrates a front view of the embodiment shown in FIG. 8.

FIGS. 8 and 9 illustrate a perspective view and a front view of an alternate exemplary embodiment of the wire nut 100 that includes additional apertures for receiving accessories that may require additional connection points. A multi wire nut 300 is shown. The multi wire nut 300 is designed to fit in the first opening 212 and a second opening 211 of the side panel or façade 205 of the wire shelf 200 as shown in FIG. 14. The multi wire nut 300 comprises a front face 330 that, in this embodiment, is comprised of molded plastic or similarly rigid material with a thickness that is at least as great as the first opening 212. In the case where the first opening 212 is triangular, the front face 330 is also triangular. The front face 330 can be inserted into the first opening 212 regardless of the first opening's 212 orientation. Each side of the outer surface of the perimeter of the front face 330, comprises at least one nib 340. The nibs 340 are of sufficient quantity to provide both an interference fit, and the ability to maintain the front face 330 centered within the first opening 212 when the front face 130 is inserted into the first opening 212. It is understood by one of ordinary skill in the art that the front face 330 could be fit within the first opening 212 as long as the front face 330 can conform to the first opening 212 to create a sufficiently rigid interference fit.

A rear face 310 is coupled to the back side of the front face 330. It is understood by one of ordinary skill in the art that the rear face 310 and the front face 330 could comprise a unitary element. The rear face 310 comprises a front surface area 317 that is larger than the front face 330. The rear face 310 as shown comprises a top portion 315 and a bottom portion 320, which in this embodiment is a pair of legs extending downward. By the rear face 310 having a larger front surface area than the front face 330, the front face 330 can be inserted into the first opening 212 using the rear face 310 so that the rear face 310 can act as a backstop and maintain the front face 330 within the contour of the first opening 212. The front face 330 further includes an aperture 350 for receiving a fastener such as a screw or bolt 361 as shown in FIG. 21. The aperture 350 extends through the width of the front face 330 and the rear face 310 in axial alignment. The rear face 310 further comprises a pair of lateral sections 370 that extend outward from the rear face 310. Each lateral section 370 is positioned on opposite ends of the rear face 310 and further comprises a lateral section aperture 380 that extends through the width of each lateral section 370. A side 375 of each rear face 310 is configured to be parallel to the top surfaces 335 of the front face 330 so that a gap 378 is formed between each side 375 and top surface 335. This configuration enables the triangular wire 210 to fit within each gap 378.

Figure 10:
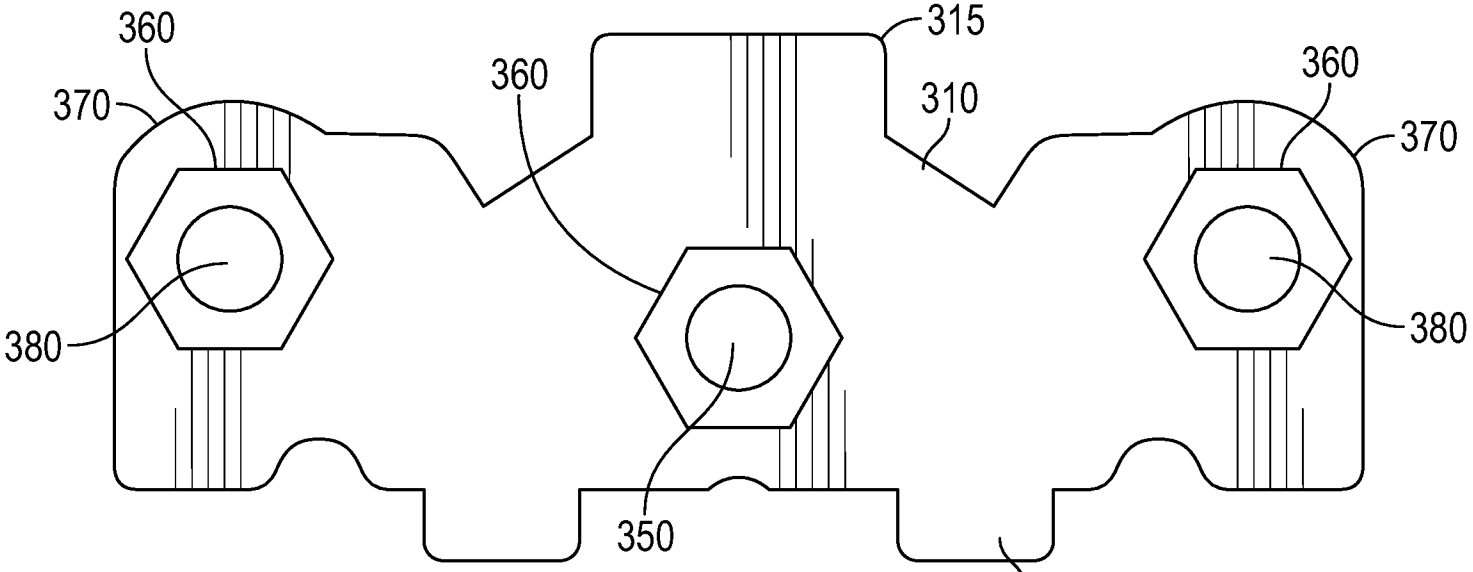
FIG. 10 illustrates a rear view of the embodiment shown in FIG. 8.
Figure 11:
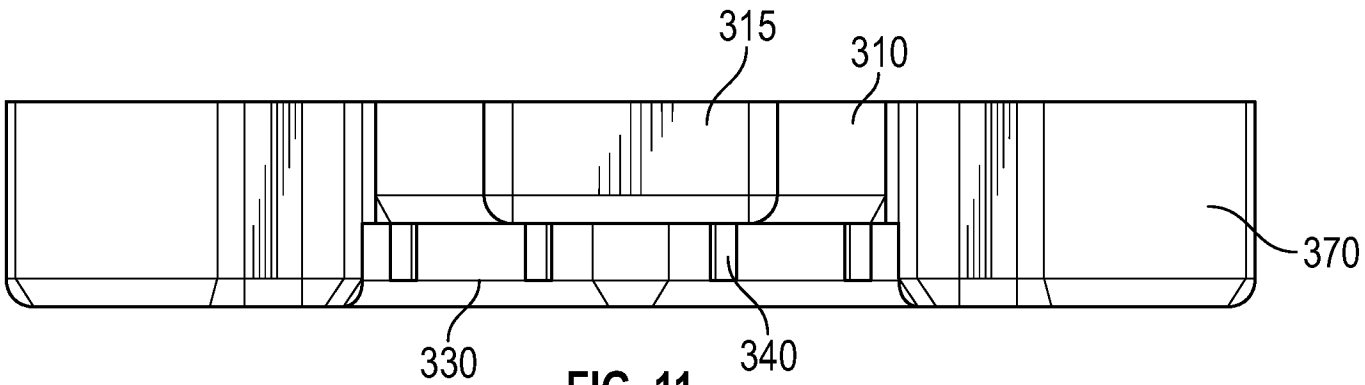
FIG. 11 illustrates a top view of the embodiment shown in FIG. 8.
Figure 12:
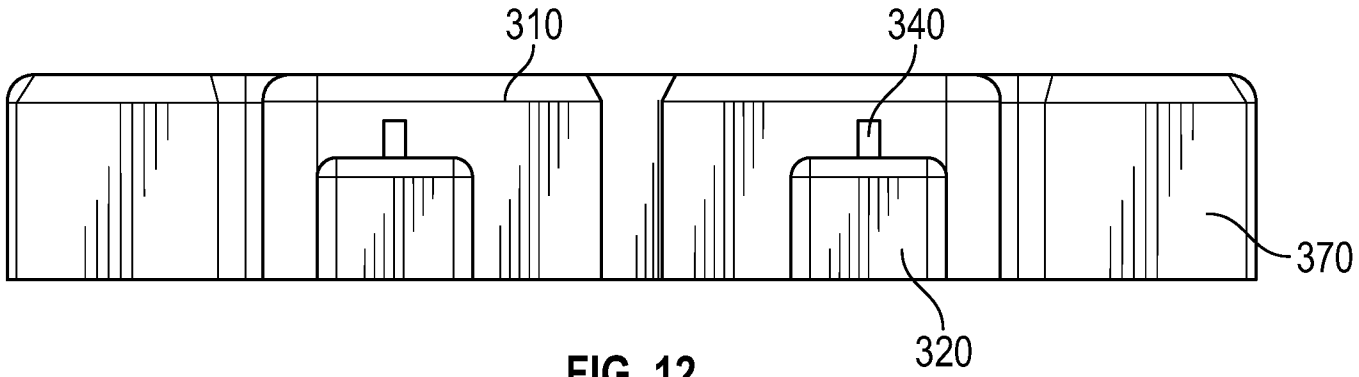
FIG. 12 illustrates a bottom view of the embodiment shown in FIG. 8.

FIG. 10 illustrates a rear view of the apparatus showing the back surface of the rear face 310. A hexagonal nut 360 is embedded in the rear face 310 and in each of the lateral sections 370 as shown. The nut 360 is threaded and is axially aligned with the aperture 350 and lateral apertures 380 and is compatible with the bolt 361 so that an external accessory can be secured to the multi wire nut 300 when the bolt 361 is inserted through the aperture 150 and the lateral apertures 380. FIGS. 11-13 show various views of the multi wire nut 300 as shown in FIGS. 8-10.

FIG. 14 illustrates a perspective view of an assembled wire nut 300 in the façade 205 of the wire shelf 200. The wire shelf 200 includes the planar mesh 240 of wires 230 that are perpendicular to the façade 205. The façade 205 includes a continuous triangular wire 210 positioned between an upper bar 215 and a lower bar 220. As can be seen, the multi wire nut 300 is inserted through the first opening 212 of the façade 205 and the nibs 340 that are positioned on the outer surface of the perimeter of the front face 330 create an interference fit within the triangular wire 210.

Figure 13B:
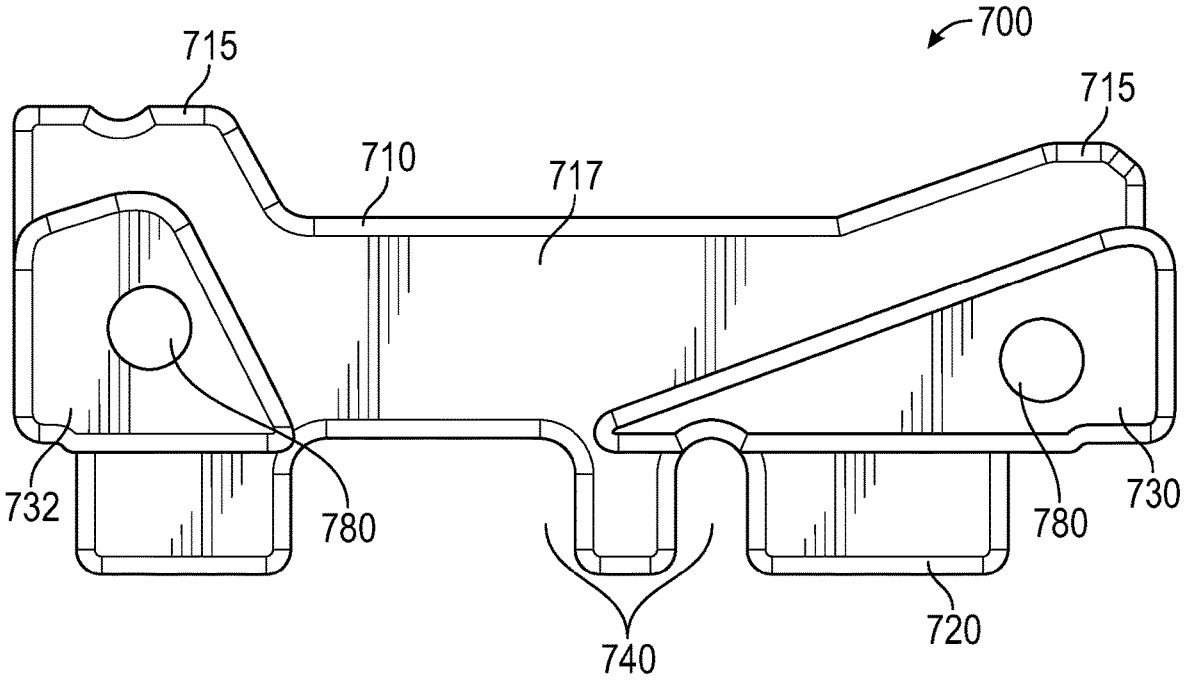
FIG. 13B illustrates a front view of an alternate exemplary embodiment of the embodiment shown in FIGS. 8-13.

FIG. 13B illustrates a front view of an alternate exemplary embodiment of the wire nut 300 that includes additional apertures for receiving accessories that may require additional connection points. A multi wire nut 700 is shown. The multi wire nut 700 is designed to fit in a second opening 214, which is the upper opening of the elongated triangular wire 216 of the side panel or façade 205 of the wire shelf 200 as shown in FIG. 14A. The multi wire nut 700 comprises a rear face 710 that is coupled to a triangular lateral section 730 and polygonal lateral section 732 that extend outward from the rear face 710. Each lateral section 730 and 732 is positioned on opposite ends of the rear face 710 and further comprises a lateral section aperture 780 that extends through the width of each lateral sections 730 and 732 and is in axial alignment with an aperture in the rear face 710. In this embodiment, the entire embodiment is comprised of molded plastic or similarly rigid material with a thickness that is at least as great as the second opening 214. It is understood by one of ordinary skill in the art that the rear face 710 and the lateral sections 730 and 732 could comprise a unitary element. In this embodiment, no nibs 340 are attached to the outer surface of the lateral sections 730 and 732, although it is understood that nibs 340 could be present.

The rear face 710 comprises a front surface area 717 that is larger than the lateral sections 730 and 732. The rear face 710 as shown comprises a top portion 715 on opposite ends of the rear face 710, and a bottom portion 720, which in this embodiment is a plurality of legs extending downward that also form recessed portions 740. The recessed portions can fit over wires 230 if necessary. By the rear face 710 having a larger front surface area 717 than the lateral sections 730 and 732, the lateral sections 730 and 732 can be inserted into the second opening 214 using the rear face 710 as a backstop to maintain the lateral sections 730 and 732 within the contours of second opening 214.

As with the wire nut 300, a hexagonal nut 160 is embedded in the rear face 710 that is threaded and is axially aligned with the aperture 780 in each of the lateral sections 730 and 732 and is compatible with the bolt 361 so that an external accessory can be secured to the multi wire nut 700 when the bolt 361 is inserted through the aperture 780.

Figure 15:
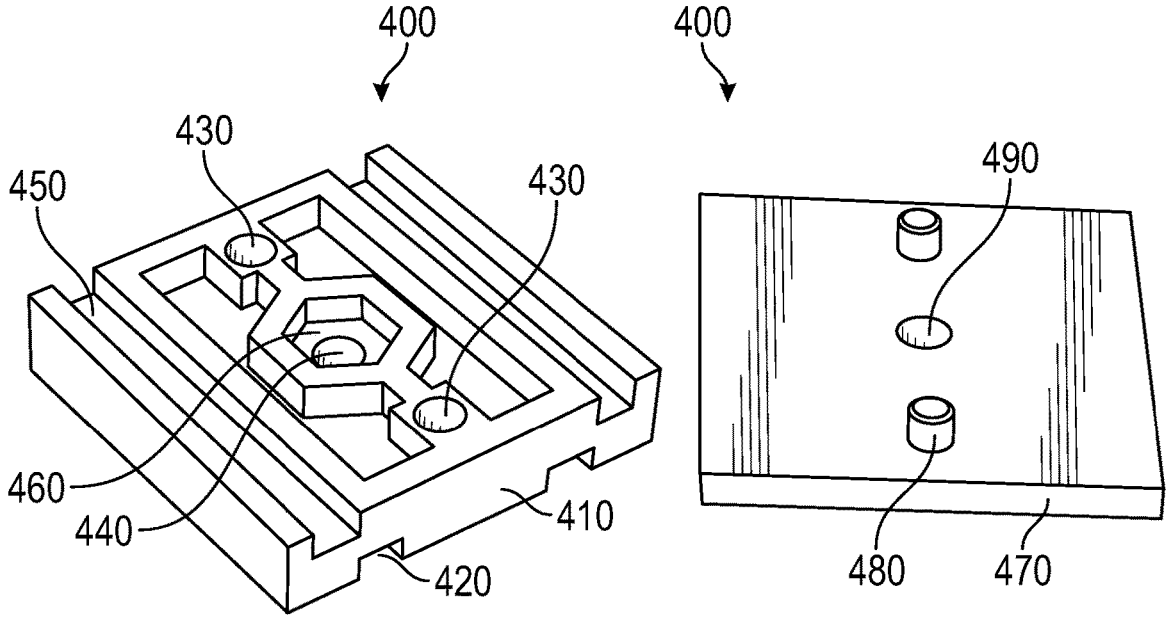
FIG. 15 illustrates a perspective view of an alternate exemplary embodiment of the present invention that includes the top side of an upper reversable portion, and a lower portion of a mount for securing accessories to the wire spacings on the surface of the wire shelf.

FIG. 15 illustrates a perspective view of another alternate embodiment of the embodiments described above. In this embodiment, a mount 400 is provided to support and level an accessory, such as shown in this exemplary embodiment as a wood plank 500 in FIG. 21, on the parallel series of wires 230 that comprise the planar mesh 240 of the shelf 200. It is understood by one of ordinary skill in the art that the accessory can be wood plank 500, or any accessory that needs to be held flat and parallel to the top of the planar mesh 240. In most wire shelves 200, the wires 230 are spaced either 20 mm or 30 mm apart. The mount 400 includes a tray 410 and a spacer 470, both of which are generally rectangular in shape, although other geometric shapes would also suffice. The tray 410 consists of a pair of top grooves 450 along the length of the top surface of each side of the tray 410 that are configured to receive wires 230 that are 30 mm apart. The top surface of the tray 410 also includes a nut holder 460 configured to receive a hexagonal nut (not shown) with an aperture 440 configured to receive a bolt 361. The top surface of the tray 410 further includes a pair of holes 430 on opposite sides of the nut holder 460 that extend through the width of the tray 410.

The spacer 470 includes an opening 490 positioned so that it is axially aligned with the aperture 440 on the tray 410. On one surface of the spacer 470, a pair of pegs 480 extend outward and are positioned and configured to fit within the pair of holes 430 on the top surface of the tray 410. When assembled, as illustrated in FIG. 21, the spacer 470 is coupled to the top surface of the tray 410 so that the wires 230 fit within the grooves 450 and the pegs 480 fit within the holes 430. The wood plank 500 can then be positioned over the spacer 470 and is then leveled along the length of the planar mesh 240 of the shelf 200.

Figure 16:
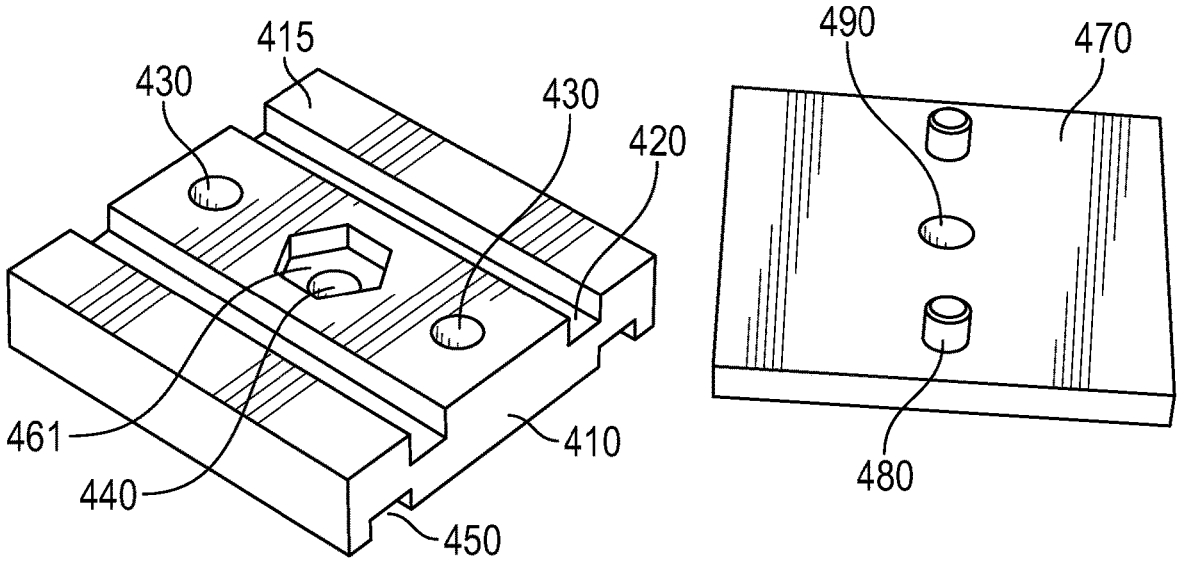
FIG. 16 illustrates a perspective view of the embodiment shown in FIG. 15 showing the bottom side of the upper reversable portion and the lower portion of the mount.
Figure 17:
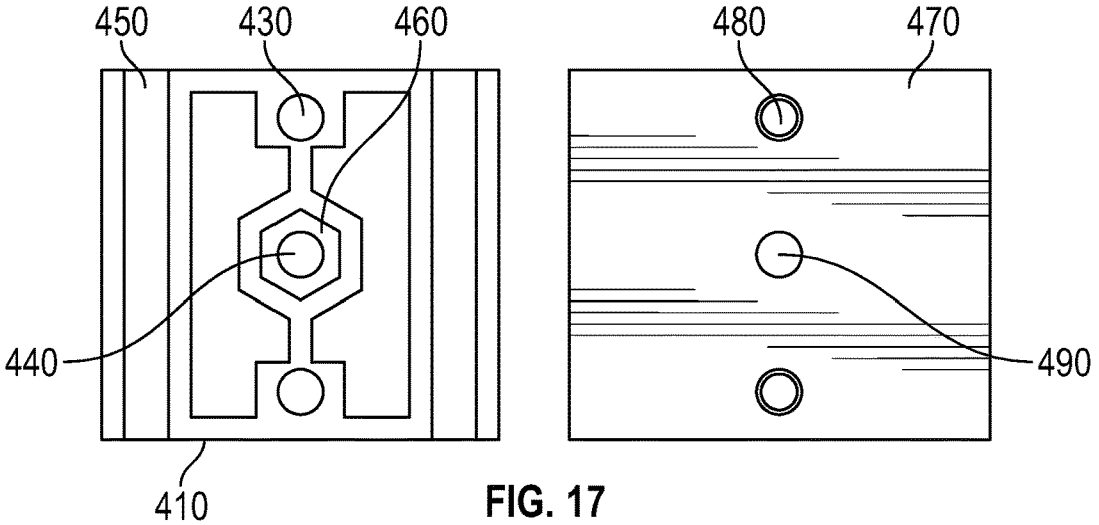
FIG. 17 illustrates a top view of the upper reversable portion, and the lower portion of the mount shown in FIG. 15.
Figure 18:
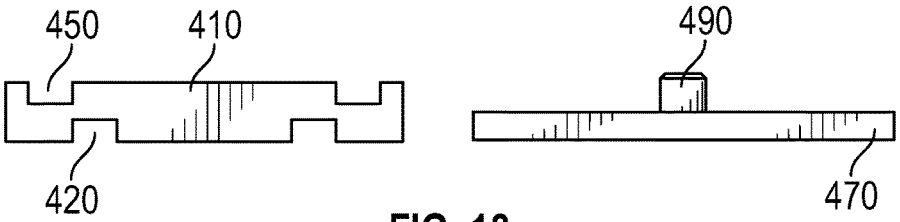
FIG. 18 illustrates a side lengthwise view of the mount shown in FIG. 17.
Figure 19:
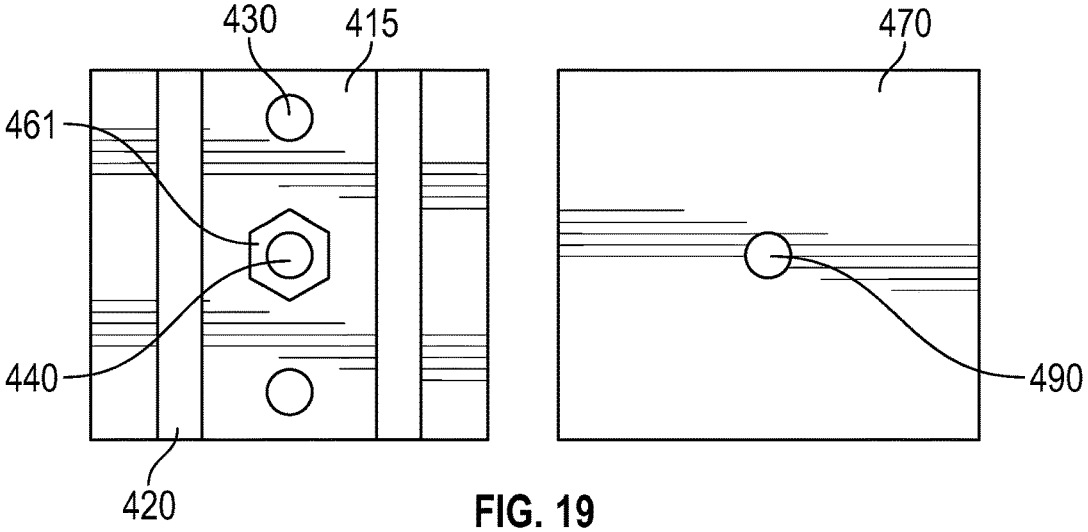
FIG. 19 illustrates a bottom view of the upper reversable portion, and the lower portion of the mount shown in FIG. 15.
Figure 20:
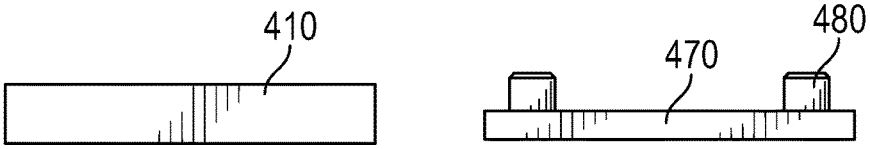
FIG. 20 illustrates a side widthwise view of the mount shown in FIG. 19.

FIG. 16 illustrates a perspective view of the bottom surface 415 of the tray 410 with the same spacer 470. The tray 410 consists of a pair of bottom grooves 420 along the length of the bottom surface 415 of each side of the tray 410 that are configured to receive wires 230 that are 20 mm apart. The bottom surface 415 of the tray 410 also includes a nut holder 461 with the aperture 440 configured to receive the bolt 361 and shows the pair of holes 430 on opposite sides of the nut holder 461. Similarly, when assembled, as illustrated in FIG. 21, the spacer 470 is coupled to the bottom surface 415 of the tray 410 so that the wires 230 fit within the grooves 450 and the pegs 480 fit within the holes 430. The wood plank 500 can then be positioned over the spacer 470 and is then leveled along the length of the planar mesh 240 of the shelf 200. FIGS. 17-20 show various views of the mount 400 as shown in FIGS. 15-16.

FIG. 21 illustrates a lower perspective view of an assembled mount 400 along the planar mesh 240 of wires 230 of the wire shelf 200. The planar mesh 240 of wires 230 shown are presumed to be spaced 20 mm apart and are assembled using the bottom surface of the bottom tray 410. As can be seen, a pair of wires 230 are inserted into the bottom grooves 420 along the lengths of the wires 230. The spacer 470 is aligned over the tray 410 so that the pegs 480 fit within the holes 430. The bolt 361 is then inserted through the aperture 440 and is tightened through the nut so that the threaded portion 362 of the bolt 361 extends downward below the planar mesh 240 of wires 230. When a wood plank 500 is placed on top of the spacer 470, the wood plank 500 can be leveled on the planar mesh 240 of the wire shelf 200.

A person with ordinary skill in the relevant art would know that any shape or size of the apparatus' elements may be adopted and fit within various shapes of openings along the facades of the wire shelves as long as the apparatus can be used to secure an accessory to the shelves. Any combinations of suitable number, shape, and size of the apparatuses may be used. Also, any materials suitable to achieve the objects of the current invention may be chosen.

What is claimed is:

1. An apparatus for securing accessories to wire shelves comprising:

a. a rear face comprising a perimeter, and a front and rear side, the front and rear side each comprising a width;

b. a front face that extends outward from the front side of the rear face, and forms an outer surface around a perimeter of the front face, the front face comprising an aperture that extends through the width of the front and rear faces that is configured to receive a fastener; and c. wherein the perimeter of the front face is less than the perimeter of the rear face.

2. The apparatus of claim 1 wherein the rear face further comprises a threaded nut that is:

a. embedded within the rear side; and b. is axially aligned with the aperture.

3. The apparatus of claim 1 wherein the front face is triangular.

4. The apparatus of claim 1 wherein each side of the outer surface of the front face comprises at least one nib.

5. The apparatus of claim 1 wherein the front and rear faces are comprised of molded plastic.

6. An apparatus for securing accessories to wire shelves comprising:

a. a rear face comprising a perimeter and:

i. a front and rear side, the front and rear side each comprising a width; and ii. a first and second end;

b. a front face that extends outward from the front side of the rear face, and forms an outer surface around a perimeter of the front face, the front face comprising an aperture that extends through the width of the front and rear faces that is configured to receive a first fastener;

c. a first lateral section comprising a width, the first lateral section is coupled to the first end of the rear face wherein the first lateral section extends outward from the front side of the rear face and comprises a first lateral section aperture that extends through the width of the first lateral section such that the first lateral section aperture is configured to receive a second fastener;

d. wherein the perimeter of the front face is less than the perimeter of the rear face.

7. The apparatus of claim 6 wherein the rear face further comprises a threaded nut that is:

a. embedded within the rear side; and b. is axially aligned with the aperture.

8. The apparatus of claim 6 wherein the first lateral section further comprises a threaded nut that is:

a. embedded within each of the rear sides of the first lateral section; and b. is axially aligned with the first lateral aperture, respectively.

9. The apparatus of claim 6 wherein the front face is triangular and comprises a first and second top surface.

10. The apparatus of claim 9 wherein the first lateral section further comprises a lateral side that is parallel to the first top surface of the front face and forms a gap between the lateral side of the first lateral section and the first top surface.

11. The apparatus of claim 6 wherein each side of the outer surface of the front face comprises at least one nib.

12. The apparatus of claim 6 further comprising:

a. a second lateral section coupled to the second end of the rear face wherein the second lateral section extends outward from the front side of the rear face and comprises a second lateral section aperture that extends through the width of the first lateral section such that the second lateral section aperture is configured to receive a third fastener.

13. The apparatus of claim 12 wherein the second lateral section further comprises a lateral side that is parallel to the second top surface of the front face and forms a gap between the lateral side of the second lateral section and the second top surface.

14. The apparatus of claim 13 wherein the front and rear faces and the first and second lateral sections are comprised of molded plastic.

* * * * *